US007779735B2

(12) United States Patent
Perini

(10) Patent No.: US 7,779,735 B2
(45) Date of Patent: Aug. 24, 2010

(54) METHOD FOR CAUSING PAPER WEBS TO TEAR OFF WITHIN REWINDING MACHINES

(76) Inventor: Fabio Perini, Via S. Francesco 1, I-55049 Viareggio (IT)

( * ) Notice: Subject to any disclaimer, the term of this patent is extended or adjusted under 35 U.S.C. 154(b) by 7 days.

(21) Appl. No.: 12/198,458

(22) Filed: Aug. 26, 2008

(65) Prior Publication Data

US 2009/0039195 A1 Feb. 12, 2009

Related U.S. Application Data

(62) Division of application No. 10/549,843, filed as application No. PCT/IT2004/000140 on Mar. 22, 2004, now Pat. No. 7,614,328.

(30) Foreign Application Priority Data

Apr. 28, 2003 (IT) ..... FI2003A0118

(51) Int. Cl.
*B26F 1/26* (2006.01)

(52) U.S. Cl. ..... 83/53; 83/24; 83/99; 83/177; 83/937; 83/949; 242/526; 242/527.1; 225/93

(58) Field of Classification Search ..... 83/24, 83/53, 78, 98, 99, 100, 177, 431, 343–347, 83/909, 924, 937, 949–950; 242/521–527.4, 242/487.1; 53/389.3; 226/7, 95, 97.1, 97.3; 492/16–20

See application file for complete search history.

(56) References Cited

U.S. PATENT DOCUMENTS

| | | | | |
|---|---|---|---|---|
| 4,216,687 | A * | 8/1980 | Passafiume et al. | 83/26 |
| 2001/0015394 | A1* | 8/2001 | Hendrix | 242/526 |
| 2002/0117575 | A1* | 8/2002 | Gilmore et al. | 242/526 |
| 2007/0181734 | A1* | 8/2007 | Corrado et al. | 242/526 |

* cited by examiner

*Primary Examiner*—Boyer D. Ashley
*Assistant Examiner*—Laura M. Lee
(74) *Attorney, Agent, or Firm*—McGlew and Tuttle, P.C.

(57) ABSTRACT

Apparatus for causing paper webs to tear off within rewinding machines, the web (2) being provided, at regular intervals, with transverse perforation which subdivide the web into sheets joined to each other but able to be separated in correspondence of said perforation lines, the apparatus comprising means to cause the tearing of the web (2) upon the passage of a perforation line (p) which separates the last sheet of a log (RO) in the course of formation from the first sheet of the next log to be formed, characterized in that the tearing means are of pneumatic type (SP) able to direct a jet of compressed air toward the line (p).

3 Claims, 9 Drawing Sheets

METHOD FOR CAUSING PAPER WEBS TO TEAR OFF WITHIN REWINDING MACHINES

CROSS REFERENCE TO RELATED APPLICATIONS

This application is a divisional under 37 CFR 1.53(b) of prior application Ser. No. 10/549,843 filed Sep. 14, 2005 now U.S. Pat. No. 7,614,328 and claims the benefit (35 U.S.C. §120 and 365(c)) of International Application PCT/IT2004/000140, filed Mar. 22, 2004 which designated inter alia the United States and which claims the benefit of priority of Italian patent application FI2003 A 000118 filed Apr. 28, 2003. The entire contents of each application is hereby incorporated by reference in its entirety.

FIELD OF THE INVENTION

The present invention pertains to an apparatus and method for causing paper webs to tear off within rewinding machines.

BACKGROUND OF THE INVENTION

The production of logs is known to imply feeding a continuous web of paper along a predetermined path. At a given point of said path, a discontinuous transverse cut is operated on the web in order to subdivide it into sections or sheets of preset length which can be torn off.

This procedure comprises using tubular cardboard elements (commonly said "cores") on the surface of which a preset amount of glue is spread to allow gluing the first sheet of the log to be formed. The procedure also provides for using winding rollers which drive into rotation the core on which the paper is wound. The log-forming process ends up when a preset amount of paper has been wound on the core. At this point, the formation of the next log begins. At the end of the formation process, it is necessary to glue the last sheet of each log on the underlying sheet to avoid the spontaneous unwinding of the same log. This type of gluing is defined as "edge closing". When a number of preset sheets result wound up on the log in the course of formation, the paper web is cut off, that is, the last sheet of the log in the course of formation is separated from the first sheet of the next log to be formed.

Patents EP 524158, GB 210568 and EP 694020 disclose devices used to cause the paper web to tear off at the end of the formation of the logs.

Such devices, however, are not suitable for the present production requirements, as they are relatively unreliable or require frequent and costly service interventions.

SUMMARY OF THE INVENTION

An object of the present invention is to overcome, or at least greatly reduce, the above drawbacks.

The advantages deriving from the present invention lie essentially in the fact that it is possible to ensure all the time the highest accuracy in causing the paper to tear off whatever the feeding speed, by eliminating abrupt movements and consequent vibrations that are likely to endanger the proper operation of the system; that an apparatus according to the invention is relatively easy to make, cost-effective as far as the maintenance is concerned, and reliable even after a prolonged service life.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
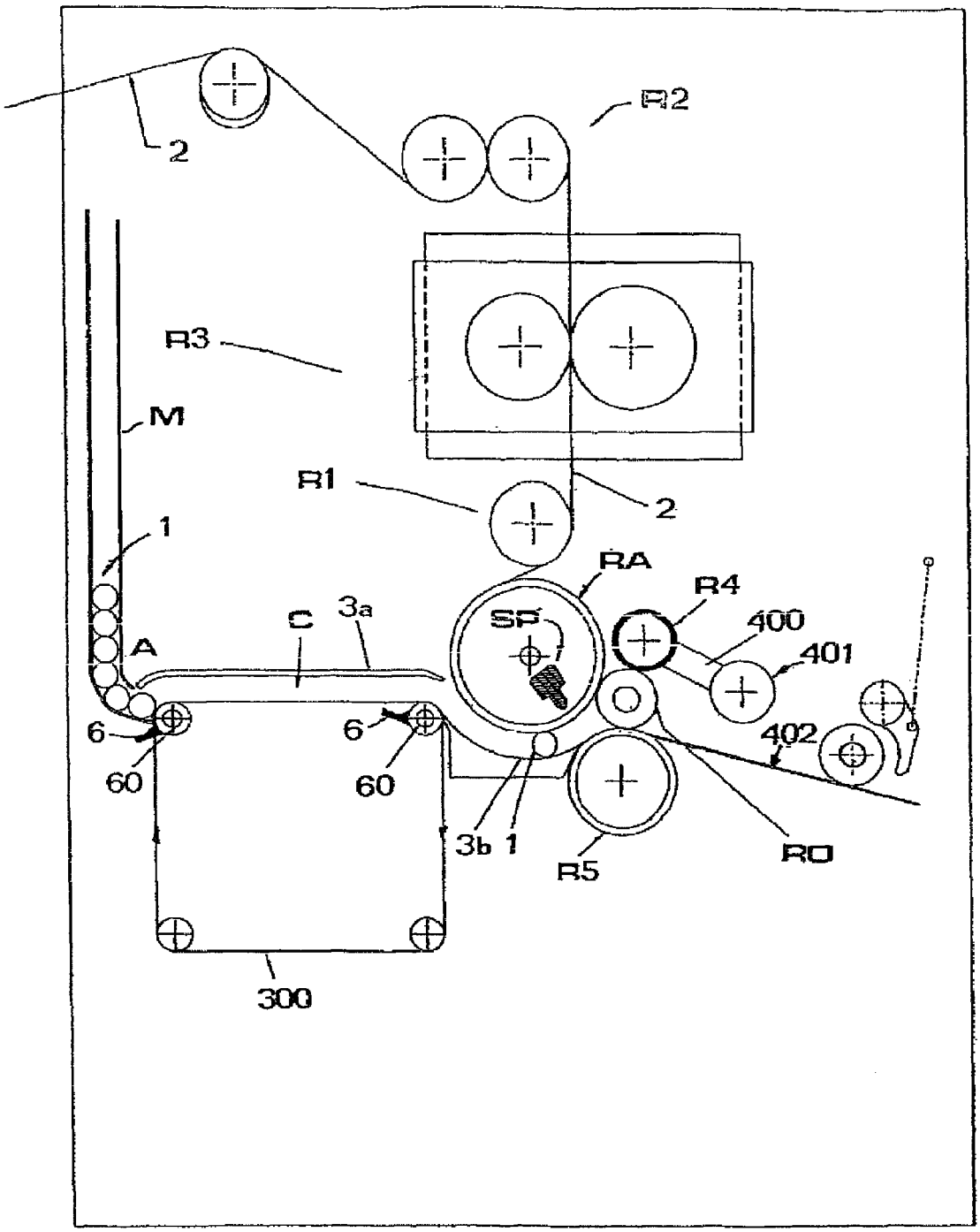
FIG. 1 is a schematic view of a rewinding machine provided with an apparatus according to one embodiment of the invention.
Figure 2:
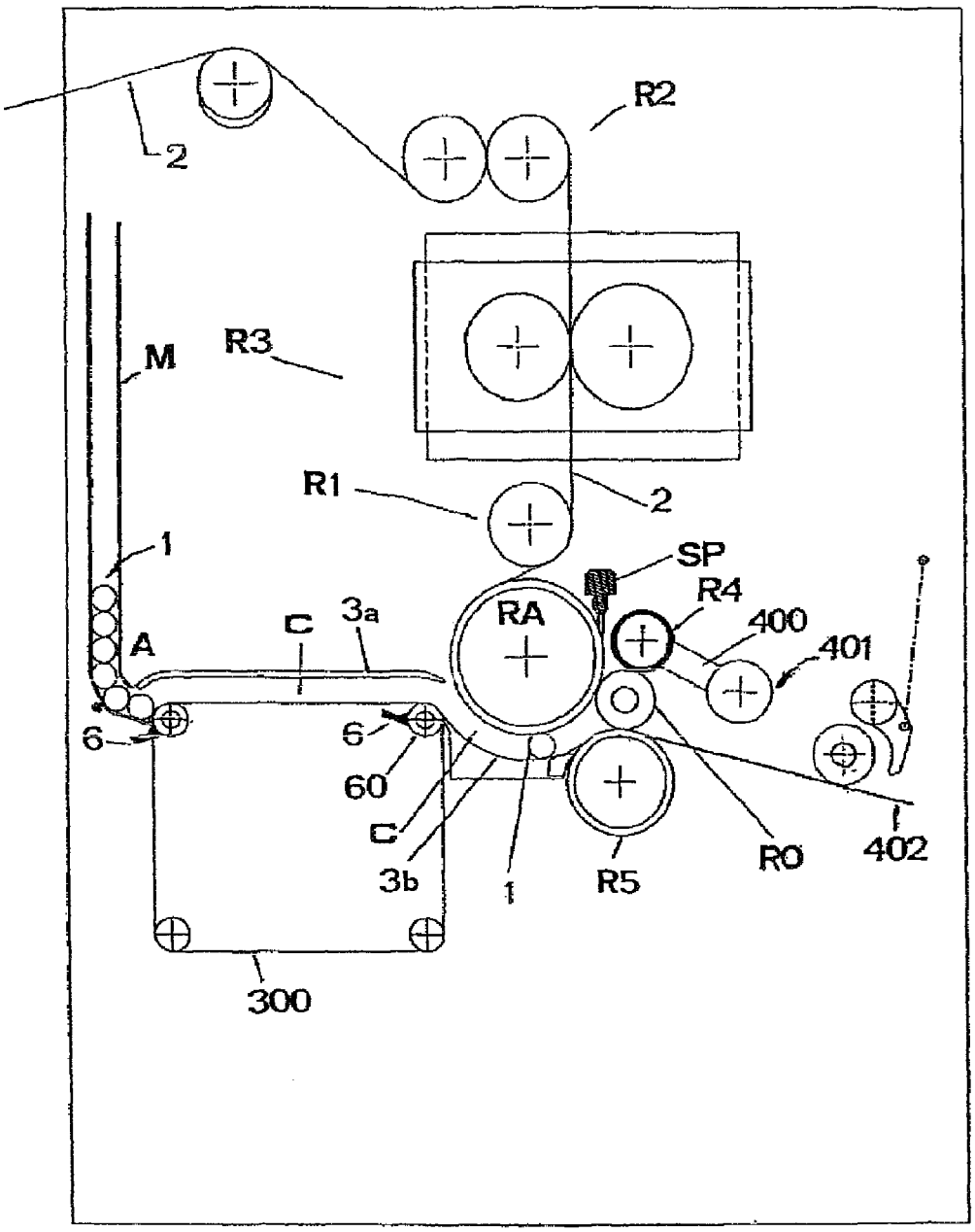
FIG. 2 is a schematic view of a rewinding machine provided with an apparatus according to another embodiment of the invention.
Figure 3:
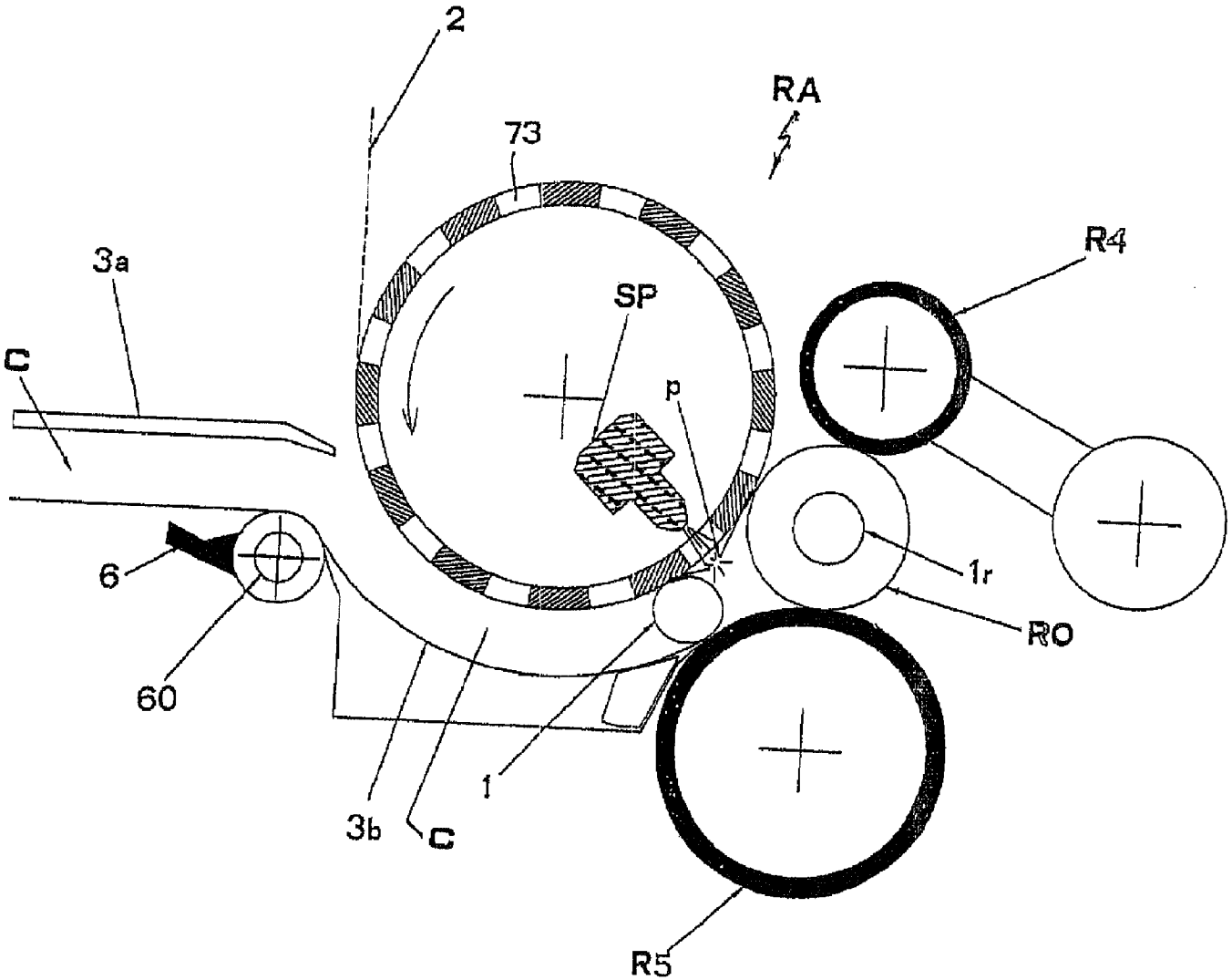
FIG. 3 is an enlarged schematic view of FIG. 1 showing the step of tearing the paper web is illustrated.
Figure 4:
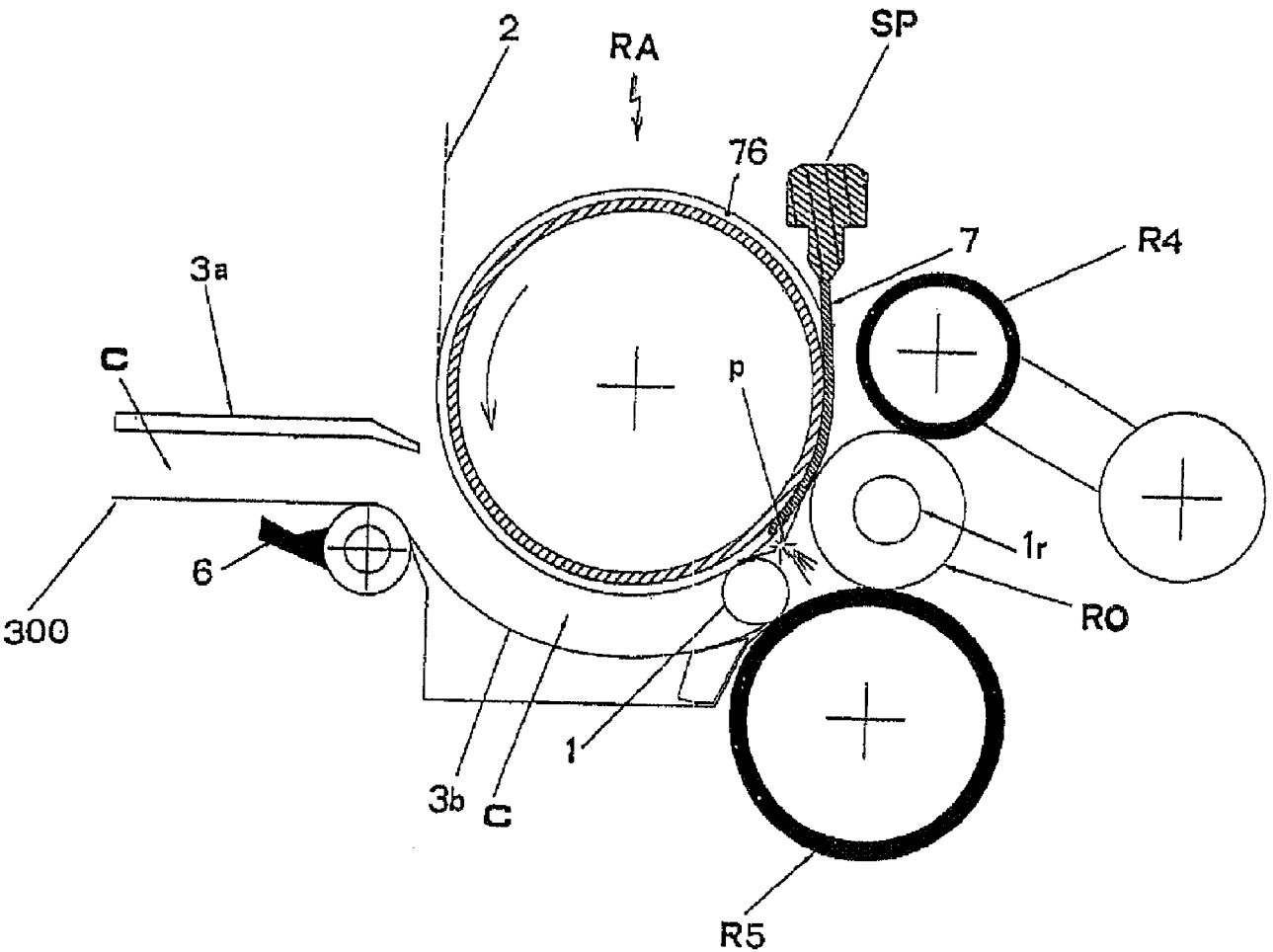
FIG. 4 is enlarged schematic view of FIG. 2 showing the step of tearing the paper web.

Referring to the drawings in particular, FIGS. 1 and 2, an apparatus according to the invention can be used within a rewinder of any possible construction, as far as the feeding and gluing of the cores (1) and paper webs (2) being used for the production of logs are concerned. Rewinding machines are known to those skilled in the art and, therefore, will not be described herein in details. Patents U.S. Pat. No. 4,487,377, EP 524158, GB 2105688, U.S. Pat. No. 5,979,818 and EP 694020 describe as many examples of embodiments of rewinding machines, so that, reference can be made thereto for a broader description of this type of machines. Essentially, and in the same way as illustrated in FIGS. 1 and 2 of the attached drawings, they comprise:

- a station (A) for feeding the cores (1);
- a store (M) for the cores (1),
- means for feeding and transversally perforating a paper web (2), with the use of a plurality of feeding, driving-out, and cutting rollers (R1, R2, R3, RA) disposed along a predetermined path;
- means for wrapping up the paper (2) onto the cores (1), with the use of a set of winding rollers (RA, R4, R5) two of which (R4, R5) being disposed one above the other at the outlet of a channel (c) delimited in part by a fixed guide consisting of two elements (3*a*, 3*b*), in part by a loop-closed conveyor belt (300), and in part by a roller (RA) which contributes both to the supply of paper (2) and the winding of the latter onto the cores (1) (differently from the rollers which contribute only to the feeding and transverse perforation of the web 2);

pusher means (6) rotating about respective axes (60) disposed along the channel (c) for cooperating to the transfer of cores (1) from the store (M), that is, from the inlet station (A), to the first length (3*a*, 300) of channel (c), and to the transfer of the same cores from the first length of channel (c) to the second length (delimited by the guide element 3*b* and by the roller RA); and means (not shown for the sake of simplicity in the figures of the attached drawings) for the gluing of the paper web (2) and cores (1) to cause the first sheet of each log (RO) to adhere on the corresponding core, and the last sheet of each log (RO) to adhere on the underlying paper.

With a procedure known to those skilled in the art, the web (2) unwinds along the delimited path from the rollers (R1, R2, R3, RA) and winds up onto the core (1*r*) in the station where the rollers (R4) and (R5) are positioned and, in cooperation with the roller (RA) and by rotating about the respective longitudinal axes, cause the paper (2) to wind up onto the core (1*r*). When a preset number of sheets (each of which being delimited by two consecutive transverse perforations of web 2) are wound up on said core, means are made to act for causing a tear of the web (2) at a site of the channel (c) located between a fresh core (1), being introduced into the same channel (c), and the station for the formation of logs (RO) wherein the rollers (R4, R5) operate. The tear is carried out in correspondence of a perforation line (p) which separates the last sheet of the log (RO) in the course of formation from the first sheet of the next log to be formed. Afterwards, the roller (R4), which is mounted on a rotating arm (400) associated with a corresponding actuator (401), is moved away from the underlying roller (R5) to release the log (RO) and making it to move away along an escape plane downstream (402). At this point, the core (1) which, while the formation of the log (RO) is being completed, moves forward and rolls along the channel (c) owing to the contact thereof with the roller (RA), the same core takes up the place of the preceding one and the cycle is identically repeated.

It is understood, however, that in view of the object of the present invention, the feeding, perforation, gluing and unloading means may be shaped and disposed in any way.

Advantageously, according to the invention, to cause a tearing of the web (2) in correspondence of the transit of a perforation line (p) which separates the last sheet of the log (RO) in the course of formation from the first sheet of the next log to be formed, means (SP) are provided able to direct a jet of compressed air toward the line (p) thereby causing—with the possible cooperation of the roller (R4) which, in a previous step, may be accelerated to stretch the web (2) in the region interested by the jet—the tearing of the web (2) in correspondence of the same line (p).

For example, reference being made to FIGS. 1, 3, 5A-5D of the attached drawings, the pneumatic means (SP) comprise a set of nozzles (7) associated, via corresponding solenoid valves (70), with a reservoir of compressed air (71): the nozzles (7), together with the respective solenoid valves (70) and reservoir (71) being positioned inside the roller (RA) whose outer surface is delimited by a tubular jacket (72) exhibiting a plurality of holes (73) through which the nozzles (7) are able to operate.

Figure 5A:
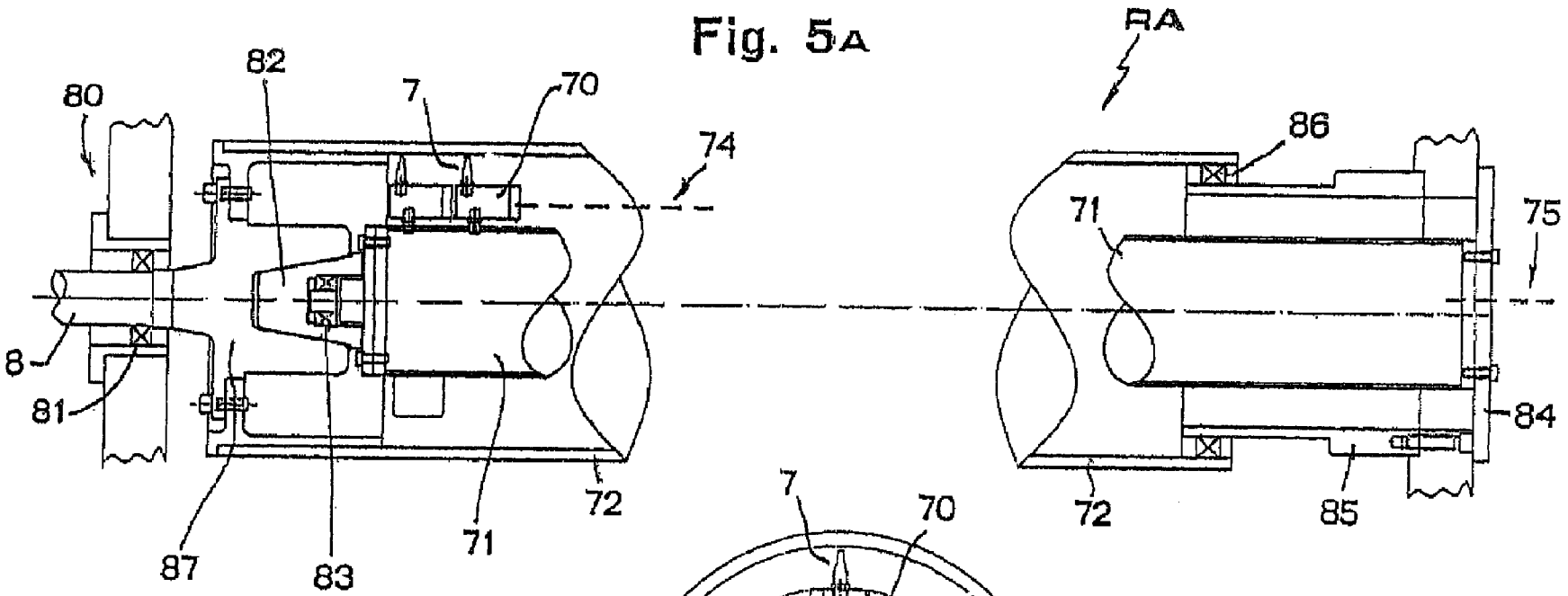
FIG. 5A is a longitudinal section view of a first exemplary embodiment of a tear-off apparatus, according to the invention, which operates according to the layout of FIGS. 1 and 3.

According to the example shown in FIG. 5A, the tubular jacket (72) rotates about its longitudinal axis while the reservoir (71) is fixed and coaxial to the same jacket (72).

To this end, as illustrated in FIG. 5A, the jacket (72) is provided with a shaft (8) with flanged head (87), which shaft is supported by the stationary part (80) of the machine with the interposition of a bearing (81), and is associated with a corresponding driving means (not shown).

Internally, the flange (87) has a seat for a conical casing (82) inside which an axial extension of the reservoir (71) is housed with the interposition of a corresponding bearing (83).

On the opposite side, the reservoir (71) is solid to a stationary part (84) of the machine and has a sleeve (85) positioned thereon, the latter having the jacket (72) coaxially mounted thereon with the interposition of a corresponding bearing (86).

In the drawing of FIG. 5A, the reference numbers (74) and (75) designate, respectively, the power cables for the solenoid valves (70) and a pipe for the introduction of air into the reservoir (71).

The solenoid valves (70) are activated to allow a flow of compressed air from the reservoir (71) through the nozzles (7), upon the transit of a perforation line (p)—separating the last sheet of the log in the course of formation from the first sheet of the next log to be formed—which takes place when the cutting rollers (R2) reach a preset number of revolutions or fraction of a revolution, for example. The consequent tearing action is rapid and accurate. The checking of the number of revolutions of the cutting rollers (R2) may be operated by means of a counter device (100) mounted on the axis of one of the same rollers (R2) in a manner known per se.

Figure 7:
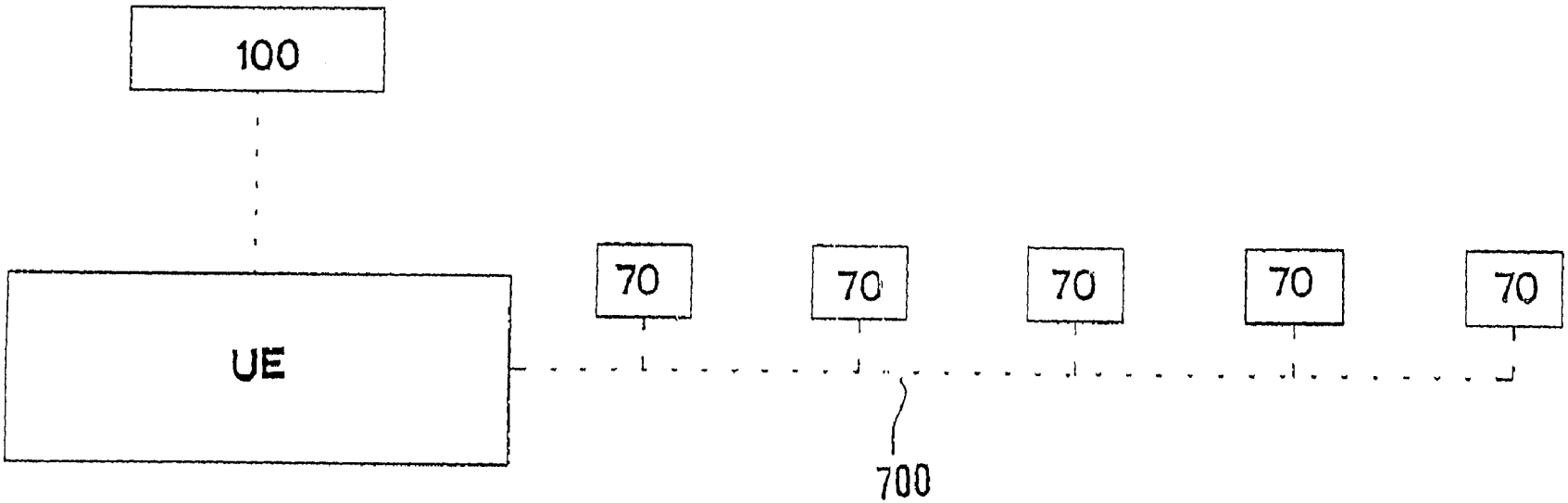
FIG. 7 is a block diagram of the system for operating the devices illustrated in the preceding figures.

As shown in FIG. 7, the activation of said solenoid valves (70) can be automated by means of a programmable electronic unit (UE) which, via the cables (700), sends electrical signals for the activation, respectively, the deactivation of the solenoid valves (70) in response to electrical signals coming from the control device (100) such as an encoder, for example. The unit (UE) is of a type known to those skilled in the industrial automation field and, therefore, will not be described in greater detail.

As above mentioned, before delivering the air flow through the nozzles (7), the roller (R4) may be accelerated in order to stretch the web (2) in the region interested by the action of the nozzles (7).

Figure 5B:
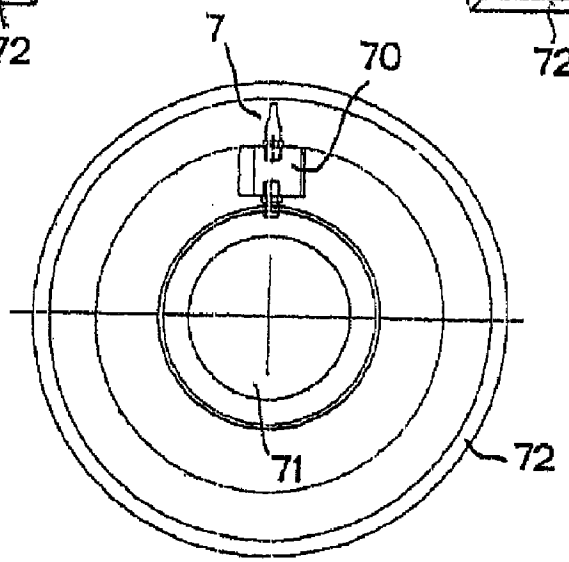
FIG. 5B is a side view of FIG. 5A.
Figure 5D:
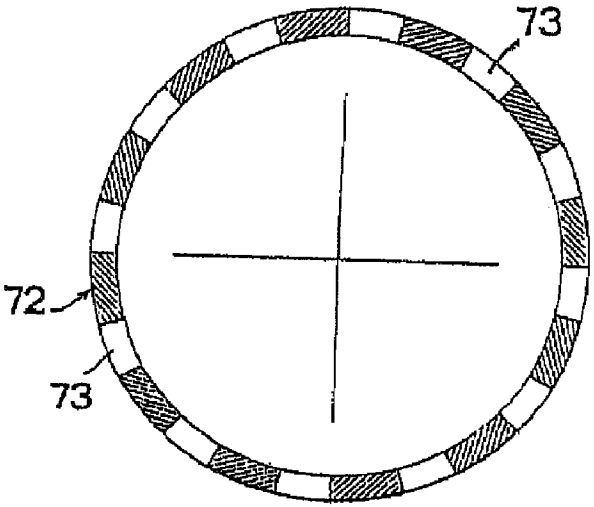
FIG. 5D is a schematic cross-sectional view of the tubular jacket shown in FIG. 5C.
Figure 5C:
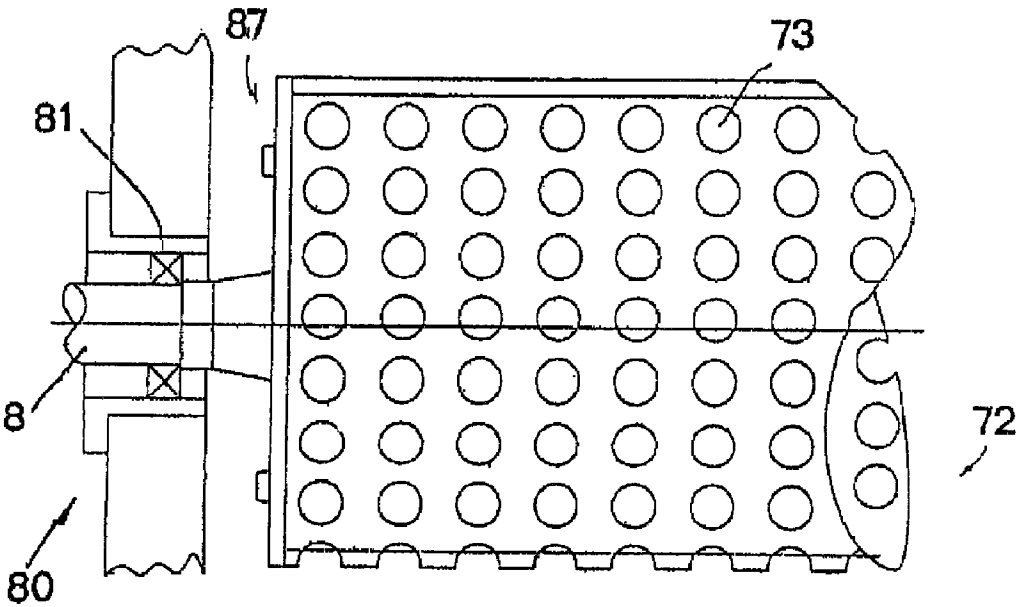
FIG. 5C is a partial side view of the tubular jacket of the apparatus shown in FIG. 5A.
Figure 6A:
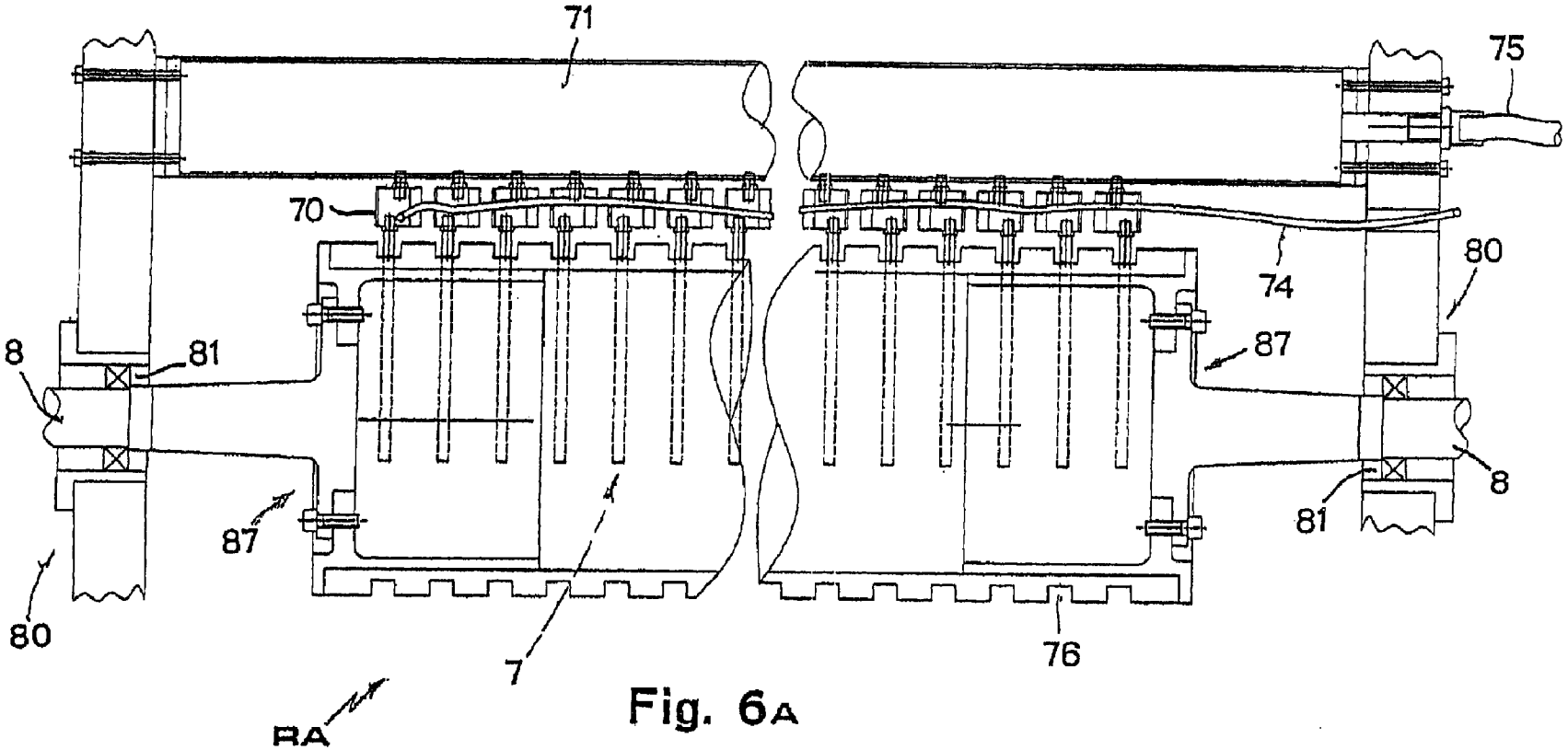
FIG. 6A is a schematic longitudinal section view of a second exemplary embodiment of an apparatus, according to the invention, which operates according to the layouts of FIGS. 2 and 4.
Figures 6B, 6C, 6D:
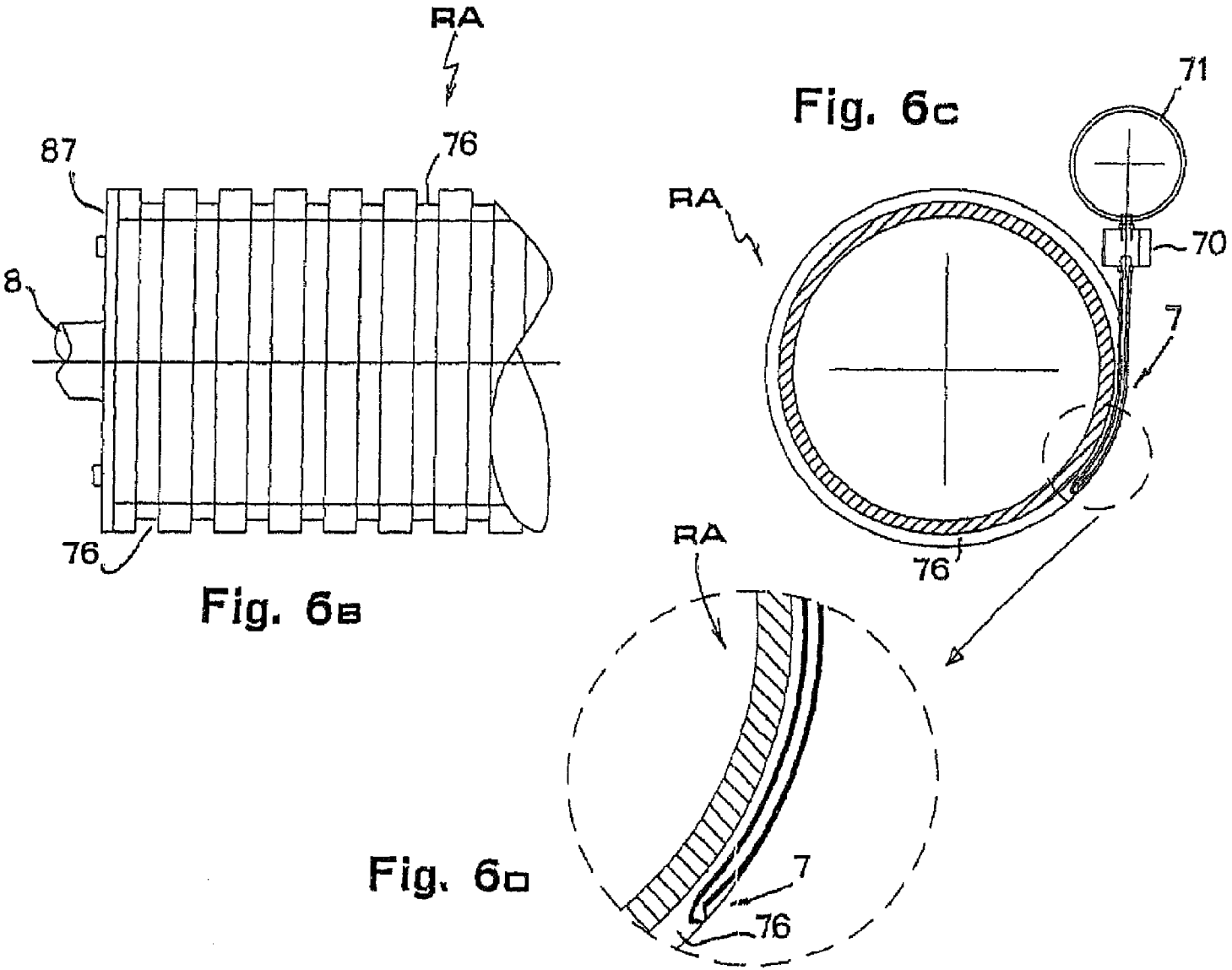
FIG. 6B is a partial side view of the external roller of the apparatus of FIG. 6A.
FIG. 6C is a cross sectional side view of the apparatus of FIG. 6A.
FIG. 6D is an enlarged view showing a detail of FIG. 6C.

Advantageously, as illustrated in FIGS. 5A and 5B of the attached drawings, the nozzles (7) located inside the roller (RA) can be oriented radially to the roller (RA).

Alternatively, as illustrated in FIGS. 2, 4 and 6A-6D of the attached drawings, the nozzles (7) can be positioned externally to the roller (RA), oriented and directed toward a region between the roller (RA) and the logs (RO)-forming station wherein the winding rollers (R4, R5) are made to operate.

To this end, the roller (RA) may be shaped in such a way as to exhibit a plurality of circumferential grooves (76) wherein the extended and correspondingly curved bodies of the nozzles (7) are positioned, the latter being associated with the reservoir (71) located outside and above the roller (RA). In this example, the roller (RA) has the two ends of the shaft (8) supported by stationary parts (80) of the machine with the interposition of corresponding bearings (81), two head flanges (87) corresponding to said stationary parts solid to both sides of the reservoir (71).

The operation of the device according to the above illustrated example is identical to that previously described.

An operating method according to the invention comprises, therefore, a step for feeding a continuous paper web (2) to a station in which the formation of a log (RO) takes place, the web (2) being provided with transverse pre-cutting or perforations at regular intervals, and implies interrupting the continuity of the web at a predetermined moment by means of a jet of fluid such as compressed air, for example, directed toward a perforation or pre-cutting line (p) of the web (2).

According to the present method, the step for the delivery of a jet of fluid may be operated subsequently to a step for the acceleration of roller (R4) which acts on logs (RO) at a log-forming station.

While specific embodiments of the invention have been shown and described in detail to illustrate the application of the principles of the invention, it will be understood that the invention may be embodied otherwise without departing from such principles.

What is claimed is:

1. A method for tearing paper webs off within rewinding machines, the method comprising the steps of:

providing a rewinding machine including a winding roller and a web-feeding roller having a tubular jacket outer surface, said tubular jacket outer surface having a plurality of openings;

providing a first core;

providing a second core;

providing a web having a plurality of transverse perforation lines, one perforation line and another perforation line defining a sheet, said plurality of transverse perforation lines including a selected perforation line, said selected perforation line defining a last sheet applied to said first core and a first sheet applied to said second core, said winding roller receiving said web via said web-feeding roller;

providing a housing located within said web-feeding roller, said housing defining a reservoir, said reservoir being filled with compressed air;

providing a plurality of solenoid valves;

providing a plurality of nozzles associated with said plurality of solenoid valves, said plurality of nozzles and said plurality of solenoid valves receiving compressed air from said reservoir, said nozzles with said solenoid valves being positioned within said web-feeding roller, said openings receiving said jet of compressed air via said nozzles;

applying said web to said first core via said winding roller until said first core receives a preset number of sheets, said winding roller rotating at a first speed such that said web is in a non-stretched state, said winding roller rotating at a second speed such that a portion of said web in an area of said selected perforation line is in a stretched state, said first speed being less than said second speed;

producing a jet of compressed air via said plurality of nozzles, said plurality of solenoid valves and said reservoir in a direction of said selected perforation line such that said jet of compressed air separates said web at said selected perforation line when said web is in said stretched state;

applying said web to said second core via said winding roller when said first core has received said preset number of sheets.

2. A method for causing paper webs to tear off within rewinding machines, the method comprising the steps of:

providing a continuous paper web, said paper web having a plurality of perforation lines, each perforation line being located at a spaced location from another perforation line;

providing a first core;

providing a second core;

providing a web-feeding roller;

providing a plurality of solenoid valves;

providing a plurality of nozzles;

providing a housing, said housing defining a reservoir, said reservoir comprising compressed air;

positioning said plurality of nozzles, said plurality of solenoid vales and said housing within said web-feeding roller;

feeding a continuous paper web via said web-feeding roller to said first core such that a first log is formed;

producing a jet of fluid via said reservoir, said plurality of solenoid valves and said plurality of nozzles;

directing said jet of fluid toward one of said perforation lines of said web such that a last sheet of said first log is separated from a first sheet of said second core.

3. A method in accordance with claim 2, further comprising the step of:

stretching said paper web in an area of said one of said perforation lines before delivering said jet of fluid to said paper web.

* * * * *